US006627192B1

(12) United States Patent
Tsakas

(10) Patent No.: US 6,627,192 B1
(45) Date of Patent: Sep. 30, 2003

(54) USE OF DUAL COMPARTMENT MIXING CONTAINER FOR ENZYME MIXTURES USEFUL TO TREAT ACNE

(76) Inventor: Spyros Tsakas, 2 Pl. Messolongiou, GR- 116-34 Athens (GR)

( * ) Notice: Subject to any disclaimer, the term of this patent is extended or adjusted under 35 U.S.C. 154(b) by 0 days.

(21) Appl. No.: 09/673,511

(22) PCT Filed: Nov. 20, 1998

(86) PCT No.: PCT/GR98/00033

§ 371 (c)(1),
(2), (4) Date: Feb. 16, 2001

(87) PCT Pub. No.: WO99/26856

PCT Pub. Date: Jun. 3, 1999

(30) Foreign Application Priority Data

Nov. 21, 1997 (GR) ..... 970100459

(51) Int. Cl.[7] ..... A61K 38/43

(52) U.S. Cl. ..... 424/94.1; 424/94.2; 424/94.6; 424/401

(58) Field of Search ..... 424/94.1, 94.2, 424/401, 946

(56) References Cited

U.S. PATENT DOCUMENTS

| | | | |
|---|---|---|---|
| 3,860,712 A | | 1/1975 | Ferrari |
| 4,315,570 A | | 2/1982 | Silver et al. |
| 4,657,534 A | * | 4/1987 | Beck et al. |

FOREIGN PATENT DOCUMENTS

| | | | |
|---|---|---|---|
| DE | 3208786 | | 9/1983 |
| EP | 0643960 | | 3/1995 |
| EP | 0694483 | | 1/1996 |
| WO | WO 8402846 | | 8/1984 |
| WO | WO 9107166 | | 5/1991 |
| WO | WO 93/19732 | * | 2/1992 |
| WO | WO 9319732 | | 10/1993 |

* cited by examiner

*Primary Examiner*—Christopher R. Tate
*Assistant Examiner*—Randall Winston
(74) *Attorney, Agent, or Firm*—Birch, Stewart, Kolasch & Birch, LLP

(57) ABSTRACT

An enzymatic powder (or tablet) is stored in a compartment contained in the closure of a vial. The powder contains enzymes from the enzymatic categories Lipases, Peptidases, Keratinases. The vial contains a buffer solution in which the enzymes will be mixed. By pressing the top of the closure, its bottom side breaks and the powder (or tablet) falls into the vial's buffer solution. Thus, an enzymatic cosmetic product is made just before its required application. By selecting these enzymatic categories and their applications fat, proteinic remnants (dead cells) and keratinic molecules can be removed so a deep skin enzymatic cleaning can be achieved. In addition, these enzymatic mixtures can open blocked sebaceous glands by dissolving sebum, dead cells and keratines that clog them. By doing so acneic symptoms diminish dramatically and sebaceous glands return to their normal function. This product proved very adjuvant in acneic therapy, since it can also be combined with antibiotic therapy given by dermatologists.

7 Claims, 1 Drawing Sheet

USE OF DUAL COMPARTMENT MIXING CONTAINER FOR ENZYME MIXTURES USEFUL TO TREAT ACNE

BACKGROUND OF THE INVENTION

This invention is drawn to enzymatic mixtures (in powder or tablet form) containing enzymes in any combination or amount of lipases and peptidases and/or keratinases for production and use in the cosmetic industry.

Enzymes in cosmetics are not widely used today since they cannot be stored in lotion, creams, liposomes etc. In addition, there are thousands of enzymes known, each of which are classified in many categories according to some common characteristic. In this case, specific enzymes have been selected, combined, restored and activated just before cosmetic application.

The present inventors had more than twenty years experimental experience using enzymes in the pharmaceutical industry. Based upon five years of trials to combine the above knowledge-experience, the present inventors have succeeded to use and apply enzymes from the above categories in cosmetics for deep enzymatic skin cleaning and acne's treatment.

WO 93 19732 describes a composition for the topical application to the skin for the prevention of dry flaky skin, dandruff or acne based on a stratum corneum chymotrypsin-like enzyme. This enzyme contributes to the dissociation of dead skin cells which will eventually accumulate in the sebaceous gland. In this way, the acneic symptoms may be aggravated.

DETAILED DESCRIPTION OF THE DRAWINGS

Figure 1:
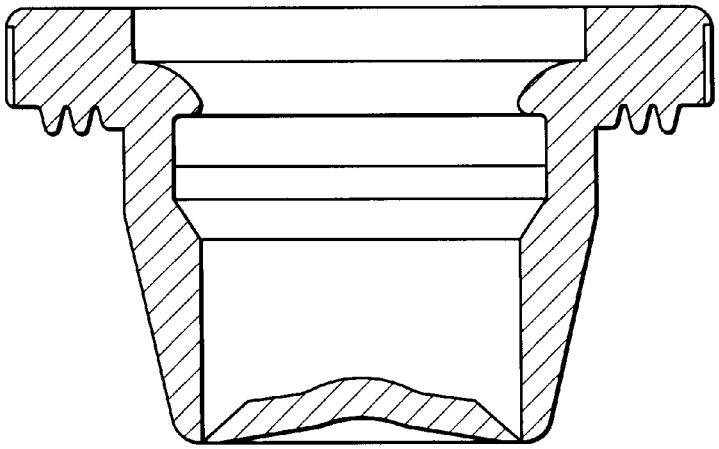
Figure 2:
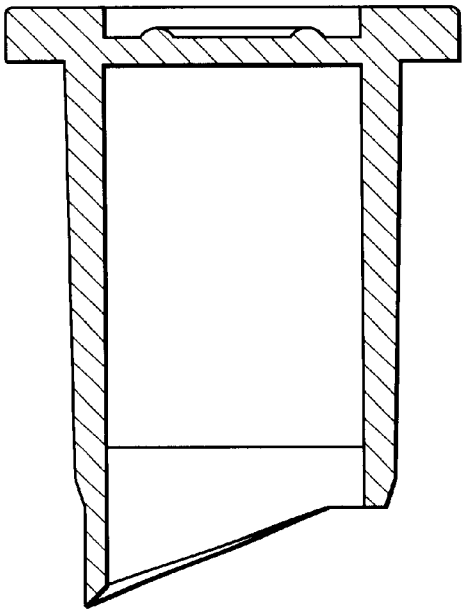

FIG. 1 is a cross section of the cork sealing the vial portion of the applicator; and FIG. 2 is a cross section of the piston-like segment place in the cork.

DETAILED DESCRIPTION OF THE INVENTION

In general, enzymes do not penetrate the skin. They operate for short periods on the outside of the skin only where their substrate exists. Lipase, for example, will act only where fat and sebum exist, to break them down (liquidizing them). So lipases will target the problem of fat collecting on the skin surface or sebum collecting in the sebaceous glands by removing fat from the skin surface or unblocking sebaceous glands by gently removing (even deeply) located sebum.

The present invention is a new generation of cosmetic products which are, more or less, target directed. Accordingly, peptidases remove (break down) dead cells from the skin surface and/or dissolve dead cell's remnants from the pores of sebaceous glands. Keratinases break down (liquidize) keratine macromolecules from both the skin surface and from blocks in the sebaceous glands where keratins can be very difficult to remove.

The present inventors have found that keratinases are a very effective but also mild treatment (using a naturally occurring protein that exists in the human body) that works externally, does not absorb through the skin, and which will operate in the pores of sebaceous glands. This gives the freedom to avoid the use of harsh keratolitic chemical substances such as benzoyl-peroxide, salicylic acid, etc., which are widely used today. These are some of the problems that are solved by the use of the enzymes from the above three enzymatic categories in any combination and amount in cosmetics for the cosmetic industry.

With regard to acne, acne is the result of anaerobic bacteria growth in blocked sebaceous glands. When the above enzymes are used, the sebaceous gland will open and function normally. The conditions within the gland will become aerobic and the acneic bacteria will be unable to establish new colonies as long as the pores are treated and remain enzymatically open. By using enzymatic treatments, acneic symptoms can not establish in the first place.

The enzymatic treatment, in one embodiment, can be combined with oral antibiotic therapy given by dermatologists.

The enzymatic mixtures (in powder or tablet form) described above should be restored in specific air-water tight compartments.

In an embodiment of the invention, is a vial having a storage place in its cork. The cork is open in the upper side (similar to a plastic cup) and in the opening of the upper side is placed the enzymatic mixture. A piston-like segment is firmly placed over the opening, from the top. The system now resembles an engine's cylinder with its piston in the upper position. The cork is firmly placed on a vial which contains a buffer solution for maximum enzymatic activity thereby enclosing the buffer solution.

The user, by pressing the piston down, breaks the bottom of the cork and the enzymatic mixture (powder or tablet) falls into the buffer solution. A freshly prepared enzymatic mixture is now ready for use.

This invention can be easily used in the cosmetic industry and can be mechanically mass produced.

The enzymatic application treatment of this invention, will provide (as seen with Velvet Clean and AcneNo) skin, which is deeply cleaned, smooth, vibrant, healthy, glowing, and young looking with reduced aging sites, such as wrinkles, and coloration (Velvet Clean). Also, the acne sebaceous gland will shortly return to normal functioning, showing also some of the above characteristics (AcneNo).

What is claimed is:

1. A method for removing from a sebaceous gland the main clogging material comprising sebum, proteinic and keratinic molecules, said method comprising: a first step of combining a buffer solution with an enzymatic mixture in dry solid form to make a buffered enzyme containing solution, and a second step of applying to the skin the buffered enzyme containing solution; wherein the enzymatic mixture comprises at least two enzymes selected from the group consisting of Lipases, peptidases and keratinases.

2. A method for the treatment and/or therapy of acne comprising: a first-step of combining a buffer solution with an enzymatic mixture in dry solid form to make a buffered enzyme containing solution, and a second step of applying to the acne the buffered enzyme containing solution; wherein the enzymatic mixture comprises at least two enzymes selected from the group consisting of Lipases, peptidases and keratinases.

3. A method for skin cleansing and/or treating acne with an enzymatic mixture in powder or tablet form, said mixture comprising at least two enzymes selected from the group consisting of Lipases, peptidases and keratinases, said method comprising the steps of:

(i) storing said mixture in an air/water tight aluminum envelope or in an air/water tight chamber provided in the cap of a conventional vial, wherein said vial contains a buffer solution at a pH which effects the action of said enzymes;

(ii) combining the dry enzymatic mixture with said buffer solution, just before skin application to prepare an enzymatic solution mixture;

(iii) applying said enzymatic solution mixture on the skin.

4. The method according to claim 2, wherein said mixtures being in dry powder or tablet form, becoming active when dissolved in appropriate solution just before application.

5. The method according to claim 3, wherein said enzymatic solution removes from a sebaceous gland the main clogging material comprising sebum, proteinic and keratinic molecules.

6. The method according to claim 3, wherein the enzymatic mixture is applied to acne.

7. The method according to claim 3, wherein said mixtures being in dry powder or tablet form, becoming active when dissolved in appropriate solution just before application.

* * * * *